United States Patent [19]

Crosslen

[11] 4,011,942

[45] Mar. 15, 1977

[54] WRISTWATCH DISPLAY CASE HAVING DETACHABLE FLEXIBLE WATCH-SUPPORTING CUFF

[75] Inventor: Louis John Crosslen, Grafton, Wis.

[73] Assignee: Frank Mayer & Associates, Inc., Grafton, Wis.

[22] Filed: Feb. 24, 1976

[21] Appl. No.: 660,866

[52] U.S. Cl. ..... 206/45.14; 206/566; 206/45.34

[51] Int. Cl.[2] ..... B65D 5/50; B65D 1/34

[58] Field of Search ..... 206/75, 45.34, 45.19, 206/45.14

[56] References Cited

UNITED STATES PATENTS

| | | | |
|---|---|---|---|
| 1,906,111 | 4/1933 | Shields | 206/75 |
| 1,944,714 | 1/1934 | Lehmann | 206/75 |
| 2,178,652 | 11/1939 | Shields | 206/75 |
| 2,219,212 | 10/1940 | Sundee | 206/75 |
| 2,925,907 | 2/1960 | Grieve et al. | 206/75 |

*Primary Examiner*—George E. Lowrance
*Assistant Examiner*—Douglas B. Farrow
*Attorney, Agent, or Firm*—James E. Nilles

[57] ABSTRACT

A wristwatch display case for displaying a wristwatch having a flexible expandable band comprises a base and a removable transparent cover which are locked together when the case is mounted on a merchandising display rack and which are separable to permit removal of the watch when the case is removed from the merchandising display rack. The base comprises a sloped rear wall having an elongated slot for receiving the watch band. The side edges of the slot are provided with notches near the ends thereof. A flat flexible watch-supporting cuff formable into a loop and insertable within the watch band is employed to releasably support the watch on the rear wall of the base. Portions of the cuff are wider than the slot, but each portion is narrower than the combined width of the slot and a pair of opposed notches at one end of the slot. Each cuff portion has slits in its opposite side edges for releasable engagement with the side edges of the slot to thereby support the watch on the base. In use, the watch band and cuff are squeezed to align the cuff portions with the notches and the band is inserted into the slot. Thereafter, the squeezing pressure is released and the slits in the cuff engage the side edges of the slot, thereby supporting the watch on the base. The cuff initially takes the form of a flat strip of flexible material such as plastic or the like which can be rolled to fit within watch bands of various sizes and is provided with friction locking means to maintain it in a loop of a desired diameter.

12 Claims, 11 Drawing Figures

WRISTWATCH DISPLAY CASE HAVING DETACHABLE FLEXIBLE WATCH-SUPPORTING CUFF

BACKGROUND OF THE INVENTION

1. Field of Use

This invention relates generally to a wristwatch display case having a watch-supporting cuff therein, which display case is adapted for releasable mounting on a carousel type merchandising display rack.

2. Description of the Prior Art

U.S. Pat. No. 3,661,273 issued May 9, 1972 to L. J. Crosslen and assigned to the same assignee as the present application and entitled "Theft-Proof Merchandise Display Having Holding Adapter" discloses a carousel type display rack for releasably supporting a display case. The prior art also discloses various types of display cases in which articles such as wristwatches, bracelets, or the like can be displayed. Some prior art display cases employ a rigid C-shaped or loop-shaped cuff to hold the article being displayed, but it is possible for the article to slip off of the cuff during shipment or handling. Thus, the possibility of damage to the article arises or, at the very least, the display case must be opened to re-secure the article.

SUMMARY OF THE INVENTION

In accordance with the present invention, a wristwatch display case for displaying a wristwatch having a flexible expandable band comprises a base and a removable transparent cover which are locked together when the case is mounted on a merchandising display rack and which are separable to permit removal of the watch when the case is removed from the merchandising display rack. The base comprises a sloped rear wall having an elongated slot for receiving the watch band. The side edges of the slot are provided with notches near the ends thereof. A flat flexible watch-supporting cuff formable into a loop and insertable within the watch band is employed to releasably support the watch on the rear wall of the base. Portions of the cuff are wider than the slot, but each portion is narrower than the combined width of the slot and a pair of opposed notches at one end of the slot. Each cuff portion has slits in its opposite side edges for releasable engagement with the side edges of the slot to thereby support the watch on the base. In use, the watch band and cuff are squeezed to align the cuff portions with the notches and the band is inserted into the slot. Thereafter, the squeezing pressure is released and the slits in the cuff engage the side edges of the slot, thereby supporting the watch on the base. The cuff initially takes the form of a flat strip of flexible material such as plastic or the like which can be rolled to fit within watch bands of various sizes and is provided with friction locking means to maintain it in a loop of a desired diameter.

A wristwatch display case having a detachable flexible watch-supporting cuff in accordance with the invention offers several advantages over the prior art. For example, the cuff itself is economically fabricated from a strip of flexible plastic material and need not be molded from rigid material as is the case in some prior art devices. Furthermore, the cuff in accordance with the invention can be rolled to accommodate wristwatches having watch bands of different sizes. Furthermore, a cuff in accordance with the invention positively engages a portion of the display case and cannot inadvertently be detached therefrom. In addition, when a cuff in accordance with the invention is associated with a wall of the display case and the watch which it supports, there is no possibility of the watch becoming detached from the cuff or from the display case because the cuff physically interferes with detachment of the watch. Other objects and advantages of the invention will hereinafter appear.

DESCRIPTION OF A PREFERRED EMBODIMENT

Figure 1:
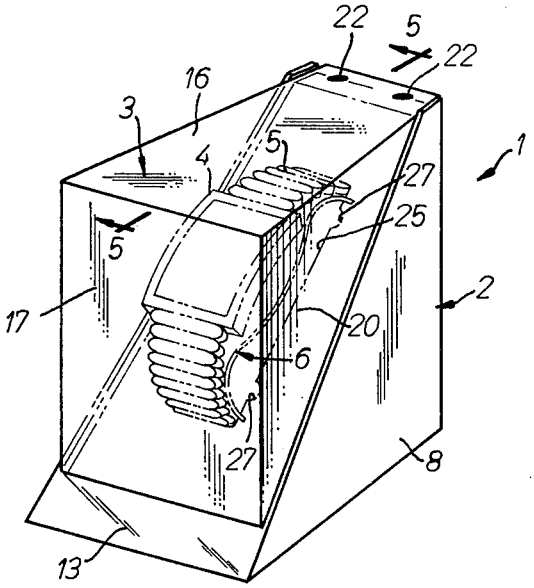
FIG. 1 is an enlarged front perspective view of a wristwatch display case in accordance with the invention and shows a wristwatch mounted therein by means of a mounting cuff.

Referring to FIG. 1, the numeral 1 designates a wristwatch display case comprising a one-piece molded base 2 and a one-piece molded transparent removable cover 3 for displaying a wristwatch 4 having a flexible expandable band 5 which is removably supported on base 2 by means of a supporting cuff 6. Base 2 and cover 3 are locked together when the case 1 is mounted on a merchandising display rack 60, shown in FIGS. 9, 10, and 11, and hereinafter described. Base 2 and cover 3 are separable to permit removal of the watch 4 when case 1 is removed from the merchandising id display rack 60. The display rack 60 performs three functions, namely: it serves to exhibit display case 1 and the watch 4 therein, it locks the display case 1 to the display rack 60 to prevent theft of the case, and it locks together the base 2 and the cover 3 to prevent theft of a watch 4 therein.

Base 2 comprises a pair of generally triangular spaced-apart side walls 8 which support a generally flat upwardly and rearwardly sloping rear wall 10. Base 2 also comprises generally horizontal upper and lower cross pieces 11 and 19, respectively, each having a pair of mounting holes 12 therethrough for a purpose hereinafter explained and a lower cross piece 13 extending between the side walls 8 and spaced from rear wall 10 to define a space or slot 14 for insertion of the lower edge of cover 3.

Cover 3 comprises a top wall 16, a front wall 17 having a lower edge 18 for insertion through space 14, and a pair of generally triangular side walls 20. Top wall 16 terminates in a rearwardly projecting portion having a downwardly projecting flange 21 which overlies and engages upper cross piece 11 of base 2. Flange 21 is provided with a projection 23, shown in FIG. 2, for securing base 2 and cover 3 together in a snap fit. Upper wall 16 is provided with a pair of holes 22 on and integral with the inner surface of the other end 40 of cuff 6. Thus, as FIG. 2 shows, when cuff 6 is rolled to a desired diameter, the projections 37 snap into engagement with appropriate holes 35 to maintain cuff 6 in rolled condition and of a size appropriate to fit within the loop formed by a watch 4 and associated band 5 of a particular diameter.

Figure 2:
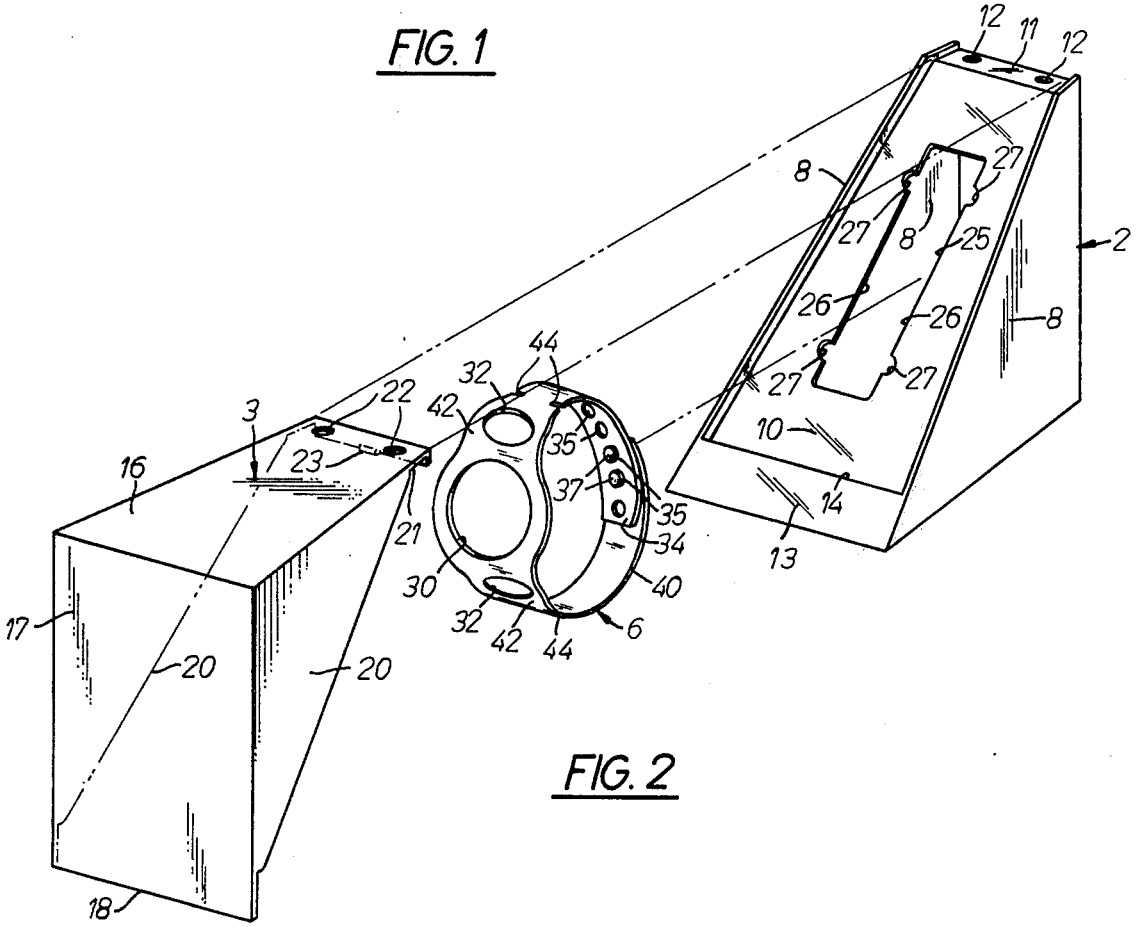
FIG. 2 is an exploded front perspective view of the case of FIG. 1 showing the base and cover of the wristwatch display case separated and showing the mounting cuff in rolled condition but separated from the base.
Figure 3:
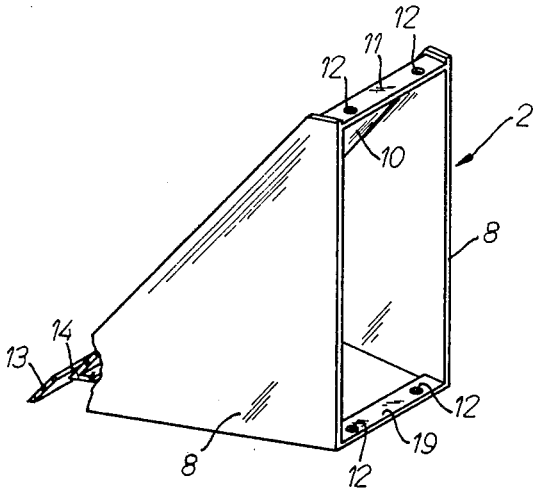
FIG. 3 is a perspective view of the rear of the base shown in FIGS. 1 and 2.
Figure 4:
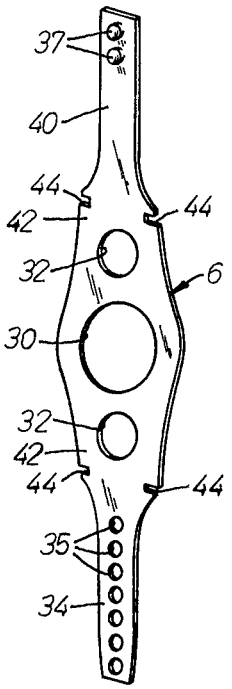
FIG. 4 is a perspective view showing the inner side of the mounting cuff of FIG. 2 in unrolled condition.
Figure 5:
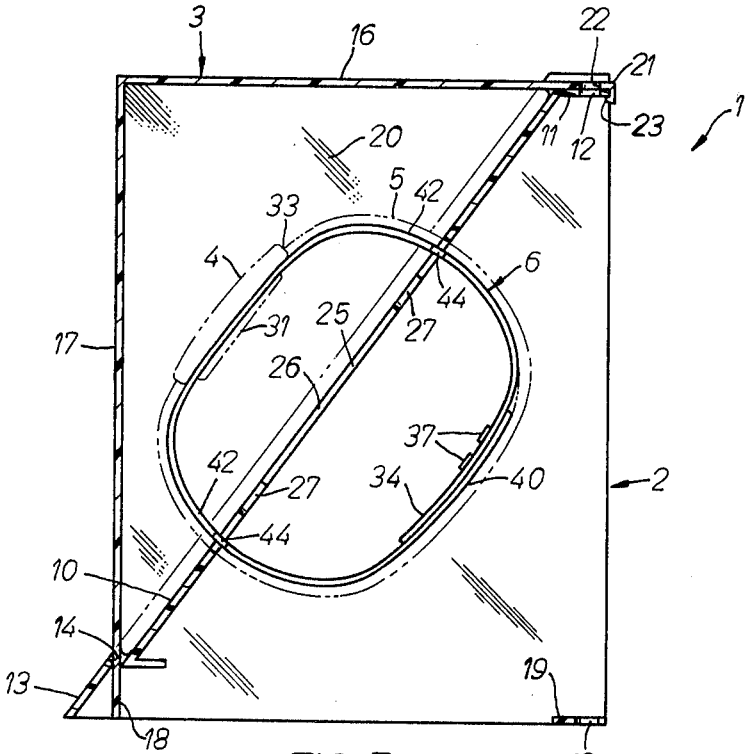
FIG. 5 is an enlarged cross-section view of the wristwatch display case taken on line 5—5 of FIG. 1 and shows the mounting cuff and wristwatch mounted therein.
Figure 6:
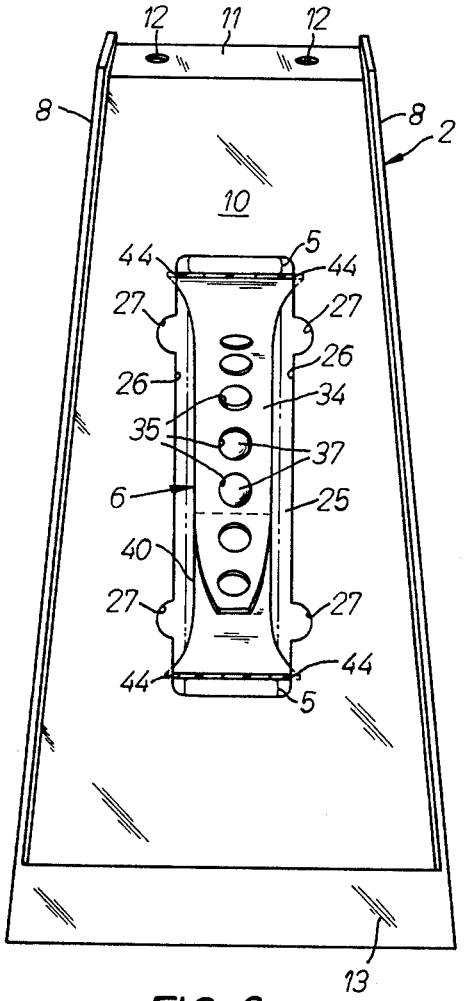
FIG. 6 is an elevation view of the front of the base section of the wristwatch display case shown in FIG. 2 and shows the mounting cuff associated therewith in engaged relationship.
Figure 7:
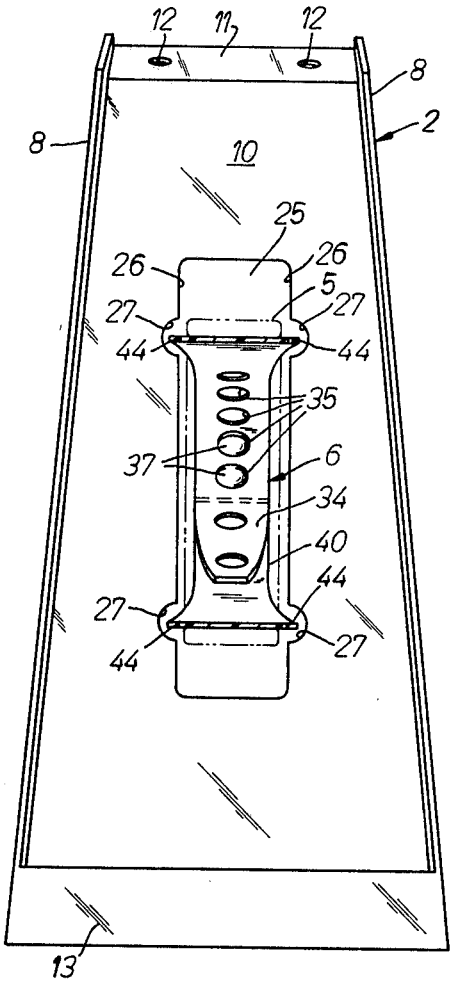
FIG. 7 is a view similar to FIG. 6 but shows the mounting cuff associated therewith in disengaged relationship, as during insertion or removal of the wristwatch from the display case.
Figure 8:
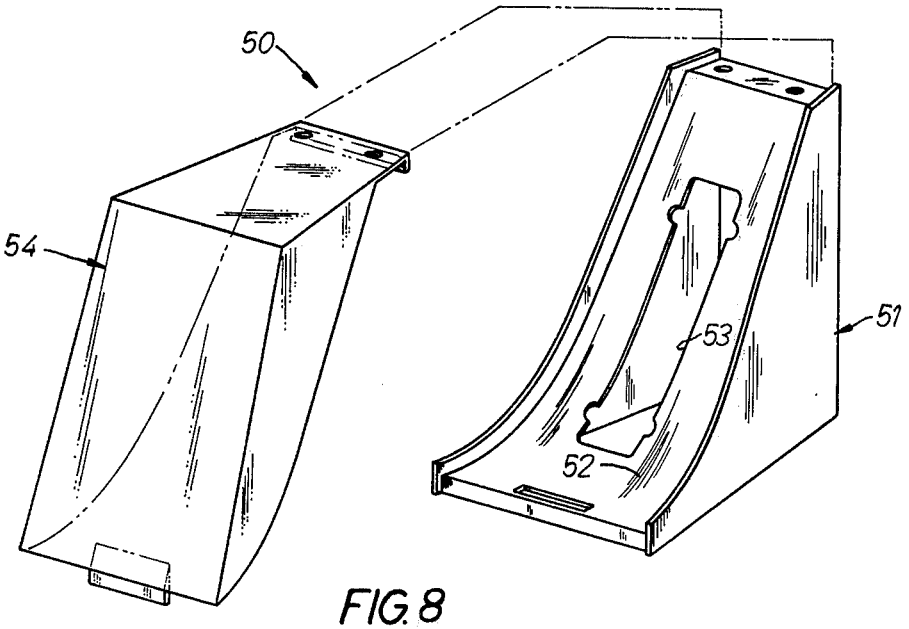
FIG. 8 is an exploded perspective view of another embodiment of a wristwatch display case in accordance with the invention.

Cuff 6 is formable into a loop or cylinder as shown in FIG. 2 and is insertable within the loop formed by watch 4 in band 5 as shown in FIGS. 1 and 5 and is employed to maintain the watch and band in somewhat rigid condition and also to support the watch on the rear wall 10 of base 2, with a portion of the watchband 5 extending into or through slot 25. As FIGS. 4, 6, and 7 best show, cuff 6 comprises cuff portions such as 42 which are wider than slot 25 but narrower than the combined width of slot 25 and the pair of notches 27 near one end of slot 25. Each cuff portion 42 is provided with slits 44 on opposite side edges thereof for engagement with the side edges 26 of slot 25 to thereby support the watch 4 on base 2. As FIG. 7 best shows, the notches 27 in slot 25 enable insertion and removal of the cuff 6 and the watchband 5 into slot 25 when the watchband and cuff are squeezed together so as to align the wider portions 42 of cuff 6 with the notches 27. After insertion, as shown in FIG. 7, the squeezing pressure on the watchband 5 and cuff 6 are released and both expand to the position shown in FIG. 6. It will be noted that the slits 44 in cuff 6 accommodate the edges 26 of slot 25 between the notches and the end of the slot. In this manner, the watch is supported on rear wall 10. As will be apparent, even if base 2 is tilted or upset as during shipment or examination, cuff 6 remains firmly engaged with the side edges 26 of slot 25 and the watch remains supported on the base 2. In order to remove the watch 4, band 5 and cuff 6 must be squeezed so as to move the portions 42 of cuff 6 from the position shown in FIG. 6 to the position shown in FIG. 7 wherein the portions 42 align with the notches 27. FIG. 8 shows a display case 50 which is generally similar to display case 1 hereinbefore described but which comprises a base 51 which has a curved, sloped near wall 52 and which a slot 53 is provided. However, it is to be understood that slot 53 is similar in construction and mode of operation to slot 25 hereinbefore described and would cooperate with cuff 6 to support watch 4 and its attached band 5 in the same manner.

Figure 9:
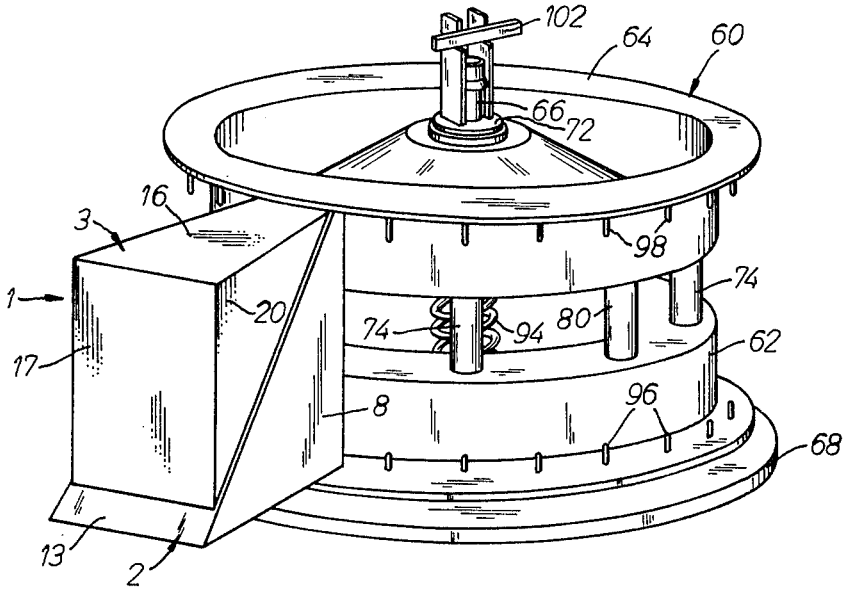
FIG. 9 is a perspective view of a merchandising display rack having a wristwatch display case in accordance with the invention mounted thereon.
Figure 10:
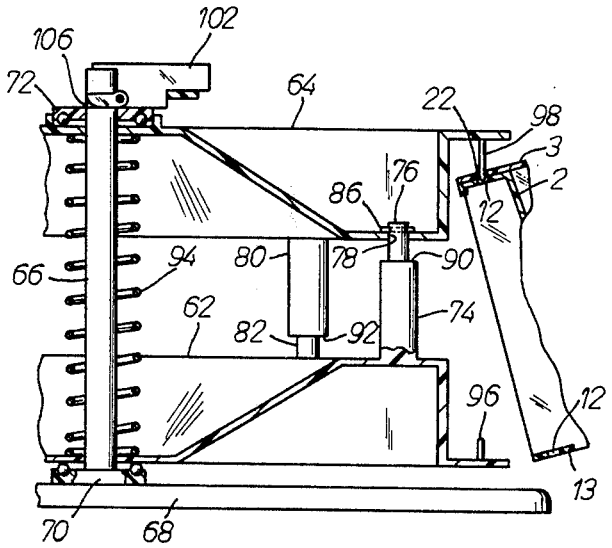
FIG. 10 is a vertical cross-section view of a portion of the merchandising display rack of FIG. 9 showing the relatively shiftable support members of the rack moved to open position to enable attachment or detachment of the display case.
Figure 11:
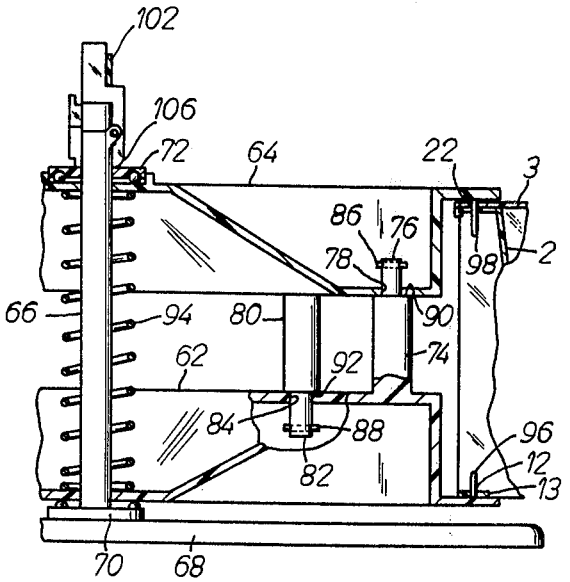
FIG. 11 is a view similar to FIG. 10 but showing the relatively shiftable support members in closed position to secure the wristwatch display case thereon in locked condition.

The display rack shown in FIGS. 9, 10, and 11 for use to support the watch display cases of the present invention includes a pair of vertically and axially spaced support members 62 and 64 shown as being of disc shape and each having a central aperture for reception on an upright shaft 66. The shaft 66 is secured to and extends upwardly from a suitable base 68.

The support members 62 and 64 are preferably rotatably received on the shaft 66, and for this purpose, suitable anti-friction bearings 70 and 72 may be provided below the lower support member 62 and above the upper support member 64, respectively. Each pair of support members 62 and 64 are also spaced axially from each other a minimum predetermined distance while being relatively axially movable to such predetermined distance. For this purpose as well as to key the members 62 and 64 of each set together and thereby prevent relative rotational movement thereof, the support member 62 is provided with an annular series of spaced upwardly directed spacer and guide posts 74, each having a reduced diameter end portion 76 slideably received in an aligned aperture 78 in the other support member 64, and the support member 64 is formed with a similar annular series of alternately spaced downwardly directed spacer and guide posts 80, each also having a reduced diameter end portion 82 slideably received in an aligned aperture 84 in the support member 62.

Axial displacement of the support members 62 and 64 is prevented by means of pins 86 and 88 which are positioned adjacent the ends of the reduced diameter portions 76 and 82. These pins 86 and 88 cooperate with shoulders 90 and 92 of the respective posts 74 and 80 to permit limited relative axial movement of the support members 62 and 64 within predetermined limits. The support members 62 and 64 are resiliently urged apart by means of a spring 94.

Each of the support members 62 and 64 includes an annular series of equally spaced and axially aligned vertical projections or spindle shafts 96 and 98, respectively, for supporting the wristwatch display cases 1 therebetween. As shown, the spindle shafts 96 project upwardly from the lower support member 62 toward the aligned downwardly projecting spindle shafts 98 of the upper support member 64. The upper spindle shafts 98 are somewhat longer than the lower spindle shafts 96 to thereby prevent free displacement of the wristwatch display cases whenever the support members 62 and 64 are spread apart. The spindle shafts 96 and 98 do permit removal of the watch display cases, however, when the support members 62 and 64 are spread apart to their fullest extent in the manner shown in FIG. 10 wherein the watch display case 1 has been moved upwardly off of the spindle 96 and pulled outwardly and then lowered to free it from the upper spindle shaft 98.

In order to lock the support members 62 and 64 in their closest position, as shown in FIG. 11, a cam lever 102 is provided at the end of the shaft 66 and above the upper support member 64. This cam lever 102 may be pivotably secured to the shaft 66, and includes a cam surface 106 co-acting with the upper bearing 72 to compress the spring 94 and move the members 62 and 64 axially toward each other when moved to the position shown in FIG. 7. As shown in FIG. 11, when the support members 62 and 64 are in this position, they closely engage the upper and lower surface of the watch display case 1 and the spindle shafts 96 and 98 received within the spaced bores 12 and 22 of the watch display case 1, preventing removal of the watch display case from the display rack 60.

FIG. 11 illustrates only one wristwatch display case 1 held by the display rack, however, it is readily apparent that a plurality of similar watch display cases could be disposed around the entire circumference of the display rack, extending radially outwardly from the display rack. In order to provide for attachment of a plurality of such watch display cases around the periphery of a carousel type merchandise display rack 60 such as that shown, the wristwatch display cases 1 and 50 are shaped such that they are narrower at the rear portion which is attached to the display rack than at the front.

In the embodiment of the invention disclosed herein, the display case 1 is shown as adapted to display a device such as watch 4 having a flexible band 5. However, it is apparent that any type of device or article having a flexible band, such as a bracelet or the like, could be mounted in accordance with the invention. Furthermore, in the embodiment shown, the supporting cuff 6 when in use defines a closed loop. However, it is to be undertood that a cuff of such a length as to define an incomplete loop and conforming to only a portion of the inner circumference of band 5 would come within the scope of the invention.

I claim:

1. In a display case for a device having a flexible band defining a loop:
   a wall having a slot for accommodating said band, and a flexible cuff insertable within said loop and having at least one portion wider than said slot and insertable therethrough when said band is flexed and said one portion having means thereon in the form of at least one slit for releasable engagement with an edge of said slot for supporting said device on said wall.

2. In a display case for a device having a flexible band defining a loop:
   a wall having a slot for accommodating said band,
   said slot having at least one notch in a side edge thereof,
   and a flexible cuff insertable within said loop for releasably supporting said device on said wall,
   said cuff having at least one portion wider than said slot but narrower than the combined width of said slot and said notch whereby said portion is able to pass through said slot and said notch,
   said portion having at least one slit for engagement with said side edge of said slot adjacent said notch.

3. A display case according to claim 2 wherein said flexible cuff is initially in the form of an elongated member which can be bent to define a loop.

4. A display case according to claim 3 wherein each end of said member is provided with fastener means which are releasably engageable with each other when said loop is formed to maintain said member in the form of a loop.

5. A display case according to claim 4 wherein said fastener means at one end of said member comprise at least one projection and wherein said fastener means at the other end of said member comprise at least one hole for engagement with said projection.

6. A display case according to claim 5 wherein said fastener means comprise a plurality of holes.

7. A display case according to claim 2 wherein said slot has at least two notches near one end thereof,
   said notches being formed in opposite side edges of said slot,
   and wherein said one portion of said cuff is wider then said slot but narrower than the combined width of said slot and said notches,
   and wherein said portion has slits on opposite sides thereof for engagement with the side edges of said slot adjacent said notches.

8. In a display case for a device having a flexible band defining a loop:
   a wall having a slot therethrough for receiving said band,
   said slot having a pair of notches near each end thereof,
   each notch in each pair being disposed in a side edge of said slot,
   and a flexible cuff for insertion within said loop for releasably supporting said device on said wall,
   said cuff having two spaced-apart portions and each portion being wider than said slot but narrower than the combined width of said slot and a pair of notches adjacent an end of said slot whereby said portion is able to pass through said slot and said pair of notches,
   and wherein said portion has slits on opposite sides thereof for engagement with the side edges of said slot adjacent said notches.

9. A display case according to claim 8 wherein said flexible cuff is initially in the form of an elongated member which can be bent to define a loop.

10. A display case according to claim 9 wherein each end of said member is provided with fastener means which are releasably engageable with each other when said loop is formed to maintain said member in the form of a loop.

11. A display case according to claim 10 wherein said fastener means at one end of said member comprise at least one projection and wherein said fastener means at the other end of said member comprise at least one hole for engagement with said projection.

12. A display case according to claim 11 wherein said fastener means comprise a plurality of holes.

* * * * *